US005170436A

United States Patent [19]

Powell

[11] Patent Number: 5,170,436

[45] Date of Patent: Dec. 8, 1992

[54] ACOUSTIC SPEAKER SYSTEM

[75] Inventor: Daryl G. Powell, Chattanooga, Tenn.

[73] Assignee: Allan L. Powell, Chattanooga, Tenn.

[21] Appl. No.: 645,045

[22] Filed: Jan. 24, 1991

[51] Int. Cl.[5] ..... H04R 1/02

[52] U.S. Cl. ..... 381/90; 381/188; 381/205; 181/181; 181/199

[58] Field of Search ..... 381/158, 159, 88, 90, 381/188, 205; 181/144, 146, 151, 156, 166, 198, 199, 181; 84/192, 189, 294

[56] References Cited

U.S. PATENT DOCUMENTS

| | | | |
|---|---|---|---|
| 722,561 | 3/1903 | Bunch | 84/294 |
| 4,168,761 | 9/1979 | Pappanikolaou | 181/156 |
| 5,004,066 | 4/1991 | Furukawa | 181/156 |

OTHER PUBLICATIONS

"Facts About Loudspeakers" Audio Engineering Mar. 1948 (Part II) Angerine et al. 181-156.

*Primary Examiner*—Jin F. Ng
*Assistant Examiner*—Nina Tong
*Attorney, Agent, or Firm*—Alan Ruderman

[57] ABSTRACT

An acoustic loudspeaker cabinet enclosure has a woofer and a tweeter mounted on a front wall and a tuned port with a duct extending into the interior of the cabinet. A pair of tuned baffles are mounted within the cabinet, one of the baffles being secured to the rear wall within the peripheral envelope of the woofer and the other of the baffles being secured to the front wall approximately half way between the position of the duct and the woofer. The baffles have a plurality of reed fingers which are excited at predetermined frequencies to resonant thereby resulting in a controlled resonance developed by the air within the cabinet to provide a bass response more transient than that of conventional speaker systems, and a smoother, deeper, more natural response. The tuned baffles within the cabinet act to provide an internal tuning port within the cabinet similar to the conventional external tuning port. In the preferred embodiment the port and duct are positioned in the rear wall. A much smaller woofer may be used than in conventional systems, so the woofer may be utilized for producing the mid-range frequencies. A crossover network for this purpose is also disclosed.

21 Claims, 1 Drawing Sheet

ACOUSTIC SPEAKER SYSTEM

BACKGROUND OF THE INVENTION

This invention relates to acoustic loudspeaker systems, and more particularly to a loudspeaker cabinet having reed baffles providing control over the resonance, air and mass created by loudspeakers mounted within the cabinet to clearly and accurately reproduce amplified input sound signals over a broad audio frequency range, thereby providing a wider bass range while providing a natural sound.

A loudspeaker cabinet enclosure serves to dampen the speakers mounted therein as well as to provide a means for preventing phase cancellation, particularly low frequency cancellation. A properly tuned enclosure will reduce "hangover" i.e., out of phase waves from the rear of the speaker cone mixing with and thereby cancelling the front wave, and improves the transient response. The cabinet or enclosure also has its own natural frequency at which it resonates, providing a larger vibrating air mass increasing bass output.

While there are a large number of loudspeaker systems in the prior art capable of high quality sound, most are deficient in producing a natural bass sound. This deficiency appears to be due to an ineffective matching between the speaker elements and the cabinet enclosure in which they are mounted. The result is a dramatic degradation of the systems dynamic range, and its ability to reproduce natural sound through the bass e.g. 20 Hz to 1 kHz range, and critical midrange frequency e.g. 1 kHz to 60 kHz range.

The most vital factor in reproducing a "clean" vibrant sound is the transient response of the speaker system. Transient response is the speaker's ability to instantaneously react to the input from an amplifier, i.e., the reaction time for the speaker to respond to electrical pulses to make sound. Although larger bass speakers or woofers generally provide a lower frequency bass response than small woofers because of the larger air mass set into vibration, they generally have a degraded transient response because the larger mass of air has a greater inertia and requires a greater amount of time to cease vibrating or oscillating after the input signal has terminated.

Speaker enclosures are generally of either the acoustic suspension type, wherein the enclosure is effectively air tight, and the ported reflex type wherein a small hole is cut into the enclosure with a tube or duct disposed within the hole to act as a partial vent for the compressing and decompressing air. In the ported reflex type, low frequency air vibrations within the port are out of phase with speaker cone motion, thereby providing a greater damping cushion to cone motion. The large volume of air through the port produces increased bass output. As the air within the enclosure is compressed and decompressed at the low frequencies, the air moves through the port. But since proper tuning is difficult to obtain, many prior art ported reflex speaker systems provide an unnatural base sound reproduction.

Additionally, although conventional speaker systems are efficient at the natural or resonance frequency of the cabinet, their efficiency degrades in other frequency ranges. Almost invariably, except for exceptionally large cabinet enclosures used with very expensive systems, the response graph of a speaker system designed to have relatively low bass response has multiple peaks and dips at the midrange frequencies, and those having reasonable flat midrange responses have poor bass response falling off drastically somewhere approximately 80 Hz. A smooth, flat response, however is more desirable than a wide range with multiple peaks and dips. For example a speaker system with a flat response from 80 Hz to 12,000 Hz can reproduce music more accurately than a speaker with a response of 30 Hz to 18,000 Hz with a sporadic response curve. The most desirable response, of course, is that which reproduces the clarity and natural sound of "live" music.

SUMMARY OF THE INVENTION

Subsequently, it is a primary object of the present invention to provide an acoustic loudspeaker cabinet enclosure having improved transient response for providing clear and natural sound reproduction over a wide frequency range including the low frequency or bass range.

It is another object of the present invention to provide an acoustic loudspeaker cabinet enclosure that provides a broad range of quality sound reproduction with improved bass response and an improved transient response over the remainder of the audio frequency spectrum.

It is another object of the present invention to provide an acoustic loudspeaker cabinet enclosure having a plurality of controlled resonant frequencies which increase the bass output to provide very deep audible distortion-free bass frequency sound reproduction with superior transient response.

Accordingly, the present invention provides an acoustic loudspeaker cabinet enclosure having tuned baffles mounted therein and disposed relative to the loudspeakers mounted within the cabinet to resonate, the resonance of the baffles resulting in a controlled resonance within the cabinet over a range of frequencies. The baffles are constructed to have a plurality of fingers or reeds which are tuned to be excited when the speakers reproduce sound at the frequency at which the reeds are tuned, the reeds being excited in a manner similar to that of a tuning fork when struck.

The baffles are spaced apart and disposed intermediate the speakers and a tuning port, so as to baffle the sound waves between the speakers and the tuning port. The tuned baffles within the cabinet act in a manner to provide an internal port within the cabinet similar to the external tuning port. With this construction small "woofer" speakers may be used to reproduce a bass output from the system which is reinforced over a selected range of frequencies rather than a single resonance frequency as in conventional systems. Thus, the speaker and cabinet size may be much smaller than the large speakers and cabinets required for conventional good bass response systems, yet providing the better transient response of the smaller speakers. This enables the bass output to be increased relative to conventional systems and gives a smoother more natural response. It also permits the woofer to provide a broad flat output response over the mid-range audio frequency range without distorting the high frequency response so that the sound output is a high quality reproduction of the audio input signal.

In the preferred embodiment of the invention disclosed herein by way of example, the cabinet has a rectangular or parallelpiped configuration having the speakers mounted on a first wall, a first baffle disposed on the opposite wall within the cabinet within the envelope of the woofer, a second baffle mounted on the same wall as the speakers disposed beneath the first baffle, and a tuned port disposed in the wall opposite to that of the speakers below the second baffle.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
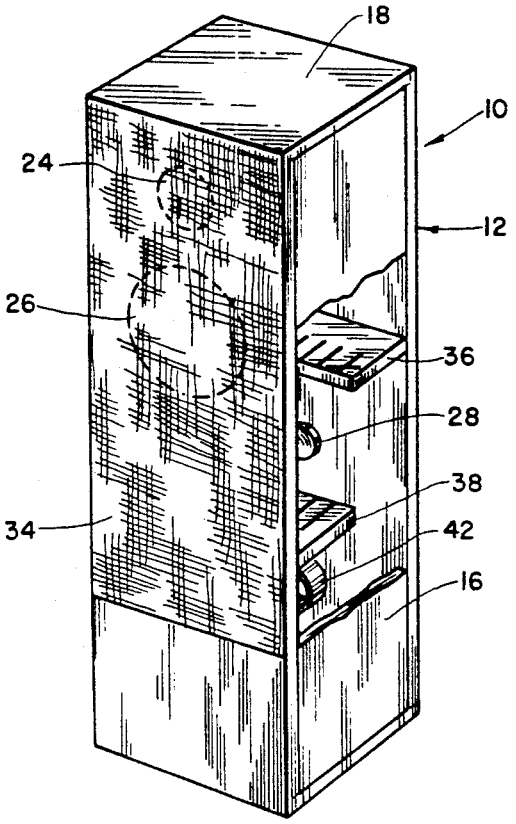
FIG. 1 is a perspective view of a speaker cabinet enclosure constructed in accordance with the principles of the present invention with portions thereof broken away.
Figure 2:
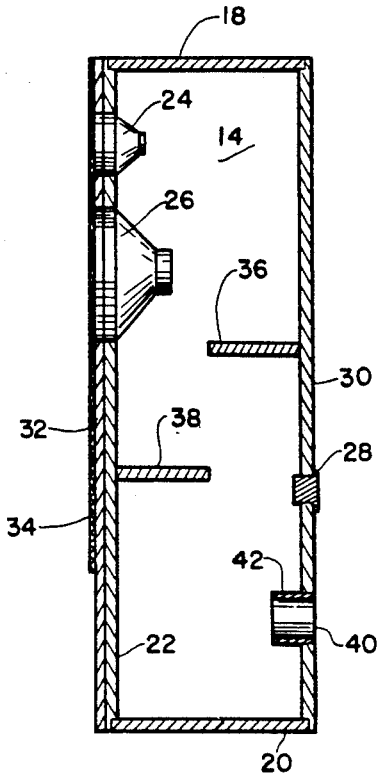
FIG. 2 is a vertical cross sectional view taken through the cabinet enclosure of FIG. 1.

Referring now to the drawings, a speaker system 10 constructed in accordance with the principles of the present invention includes a cabinet enclosure 12 having a rectangular or parallelpiped configuration including a pair of sides 14, 16, a top 18, a bottom 20, and a mounting board 22 at the front, all of which may be plywood or preferably particle board. In the preferred embodiment a tweeter or high frequency speaker 24 and a woofer 26 are mounted on the mounting board, the woofer conventionally being mounted below the tweeter, while the crossover electrical network, illustrated in FIG. 4, for dividing the sound frequency spectrum into discreet ranges routed to the appropriate speaker may be mounted in a terminal plate 28 on a rear wall 30 of the cabinet. The mounting board has openings about which the speaker cones are mounted, and a grille board 32, which may be a grille frame, is mounted on the mounting board for attaching an aesthetic grille cloth 34 in conventional manner.

Disposed within the enclosure defined by the sides 14, 16, top 18, bottom 20, mounting board 22 and rear wall 30 is acoustic baffle defining means. In the preferred embodiment, there are a pair of baffles 36, 38 which extend substantially from side 14 to side 16 and partly from the back toward the front in the case of the baffle 36, and from the front partly toward the back in the case of baffle 38. An external tuning port 40 having a tube or duct 42 is disposed beneath both baffles 36, 38, and although the port 40 and the duct 42 may in the front, in the preferred embodiment they are in the rear wall as illustrated.

Figure 3:
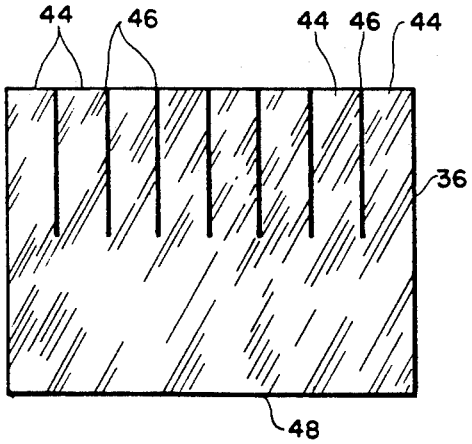
FIG. 3 is an elevational view of one of the baffles.

Each baffle 36, 38 comprises a plate, preferably constructed from particle board, but which may be constructed from other materials such as plywood or plastic, the baffles having a series of side-by-side fingers or reeds 44 as illustrated in FIG. 3 with regard to the baffle 36. The reeds are defined by spaced apart slots 46 cut into the respective baffle from one elongated edge partly toward the other edge 48. The edge 48 is secured, by gluing or the like, to the inner surface of the rear wall 30 or the inner surface of the mounting board 22 as the case may be so that the reed fingers 44 of each baffle are directed away from the wall on which the baffle is mounted and extend into the hollow central portion of the cabinet. Each of the baffles extends from the respective front or rear wall substantially half the depth of the cabinet in the preferred embodiment. When installed in the cabinet, the reed fingers resonate to reinforce the bass frequencies as hereinafter described, the reed fingers being excited by sounds emitted from the woofer in a manner similar to the excitation of a tuning fork that has been struck. Once the reed fingers have been excited, a controlled resonance is developed within the cabinet and the entire cabinet vibrates.

The resonating frequency of the reed finger baffles can be varied by the selection of the thickness of the baffle plate and the spacing between the fingers. The thinner the the baffle plate, the lower its resonating frequency, and the wider the slots between the fingers, i.e., the narrower the fingers, the lower the resonating frequency. The precise resonating frequency of the baffles is determined by a trial and error procedure for use in a particular cabinet. As aforesaid, since the reed finger baffles act as an internal port within the cabinet, the sound waves effectively "see" a smaller cabinet as the air being compressed and decompressed moves through the space between the baffles at the mid-range and bass frequencies. The reason for this appears to be because at the high frequencies the smaller waveform strikes the reed baffles and are reflected back. At the mid-bass frequencies the lower baffle effectively creates a cabinet of a size between the lower baffle and the top of the cabinet, and at higher frequencies the upper baffle effectively creates and even smaller cabinet. The reed fingers thus act to restrict the movement of higher frequency waves to the tuned port 40 and tube 42. At the low bass frequencies since the air is moving at a much slower speed, and the waveform is larger, the air not only excites the reed fingers, but also can move in and out of the tuned port 40 and tube 42. The overall effect is that at low bass frequencies the effective volume of the cabinet is increased, but at the higher frequencies the effective volume is reduced. The overall effect is a smoother more controlled bass response without fall-offs or peaks in performance in the frequency response.

A conventional ported reflex cabinet design permits the air as it compresses and decompresses to move in and out of the port at low frequencies, but the reed baffles accentuate this effect and create the same effect at frequencies other than that at which the port 40 is tuned. The fingers as they vibrate resonate and amplify the bass frequencies. The effect is such that the entire cabinet actually vibrates in the bass range. Thus, a smaller woofer can be used in a cabinet of the present invention so that a mid-range speaker is not required, and the mid-range can be obtained through the small woofer. Additionally, because a smaller speaker has less cone inertia, the transient response is substantially improved relative to the larger woofers used in conventional cabinet designs. A conventional cabinet of the same size as one constructed with the baffles of the present invention has a higher resonance frequency than a cabinet having the baffles. The lower resonating frequencies of the baffles result in the entire cabinet becoming a vibrating mass thereby increasing the bass response.

The procedure to position and tune the baffles within the cabinet involves first constructing a cabinet having the appropriate volume, port size and tube length, the cabinet being constructed in conventional manner. For example, as well known in the art, to determine the volume of the cabinet the equation is used wherein, the volume of the cabinet enclosure is equal to the resonance magnification (Q) of the woofer being used raised to the 2.87 power multiplied by the compliance of the woofer ($V_{as}$) and multiplied by 15. The tuning frequency for the enclosure is next calculated by a standard equation related to the Q of the woofer and the free air resonance ($F_s$) of the woofer. Conventionally this frequency is equal to Q raised to the −0.9 power multiplied by $F_s$ and by 0.42. The size of the port 40 and the length of the tube 42 is then determined either by equations or standard tables as is well known in the art. The position of the baffles are then determined. Since the baffles act as an internal port, the spacing between the baffles should be such as to create a volume between the baffles substantially equivalent to that which an external port duct would have at that same tuned frequency. Generally the upper baffle 36 will be located on the rear wall somewhere within the envelope of the circumference of the woofer, and the lower baffle 38 will be located approximately half the distance between the center of the woofer and the disposition of the port 40. The baffles are thus initially disposed at these locations relative to the woofer and the port.

Prior to securing the baffles within the cabinet a response curve is developed plotting the sound level in db against the frequency in Hz. The response curve conventionally will have a number of peaks and dips at various frequencies. At the frequencies at which the dips occur reinforcement of the sound level is required while any peaks that result should be reduced. After the baffles have been installed, a response curve is then again generated to determine whether the peaks and dips have been eliminated. When the maximum increase in sound level occurs at the desired frequencies, the reed fingers have been properly positioned. The baffles may be moved to other dispositions if the desired result has not been achieved. If at a particular frequency the results are not as desired, the baffles may be recut to form the reed fingers to provide either a higher or lower resonating frequency and the procedure is continued until the response curve is as desired. The response curve is generated in conventional manner using a tone generator and a sound level or db meter. Thus, the disposition of the reed fingers is dependent on a number of factors including the specific configuration and volume of the cabinet, the various acoustic parameters for the woofer, the disposition of the woofer, and possibly the number of speakers.

In the embodiment illustrated a 6 inch diameter woofer is utilized having a Q of 0.4, a $V_{as}$ of 1.5, and a free air resonance ($F_s$) of approximately 50 Hz disposed approximately 12 inches beneath the top of a cabinet having an overall length of 36 inches. The internal configuration of the cabinet had a depth and width of 9.25 inches, and the port was circular with a 3 inch diameter having a 2.5 inches long duct located approximately five inches from the exterior surface of the bottom. The baffle 36 was found to be properly disposed at 15 inches from the interior surface of the top, with the lower baffle 38 disposed at 22 inches from the outer surface of the top. In this preferred mode of the invention, the baffle plates 36, 38 are 9.25 inches long by 4 inches wide and ⅝ inches thick, the reed fingers 44 being cut so as to be half of the width, i.e., 2 inches, there being 8 reed fingers 44 each of which being 1.125 inches wide including the slot 46. Although, in this embodiment the port 40 is disposed in the rear of the cabinet, in other embodiments the port 40 may be in the front while the upper reed finger baffle 36 remains on the back wall and the lower reed finger baffle 38 remains on the front mounting board. Thus, the position of the baffles do not appear to be related to the front or rear disposition of the port, although the vertical position of the baffles may vary for a given size cabinet. If a greater number of speakers is utilized in the cabinet the relative disposition of the baffles, that is the front and rear disposition may vary, although it appears that the upper baffle should be on the back wall somewhere in the envelope between the center of the woofer and the lower portion of its circumference.

It has been found that with this construction a bass response much more transient than conventional speakers results and the bass output is reinforced over a wide range of frequencies, rather than only one frequency as in conventional cabinets. This provides the ability to increase the bass output substantially beyond conventional cabinets giving a smoother more natural response. The response curve for the preferred speaker system is substantially flat from 30 Hz to 17 KHz with the sound level falling off slightly at 25 Hz and beyond 18 Khz.

Figure 4:
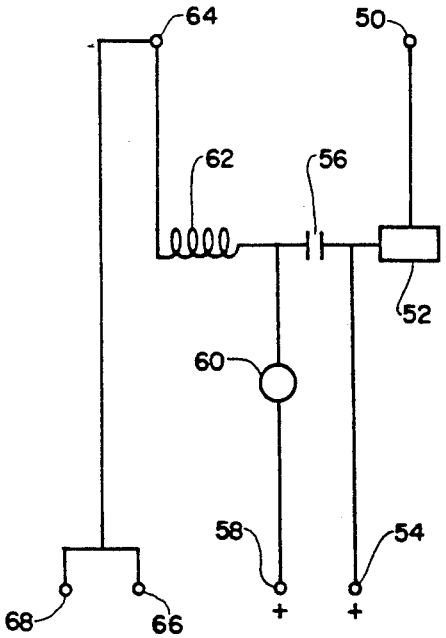
FIG. 4 is a schematic drawing of a cross-over network which aids in providing improved mid-range frequency response of the woofer in the sound system of the present invention.

As aforesaid, in the preferred mode of the invention, only a woofer 26 and a tweeter 24 are utilized. The mid-range frequencies are created by the woofer. Since a small 6 inch woofer is utilized in the preferred embodiment, good mid-range transient response is obtained utilizing a cross-over circuit as illustrated in FIG. 4, wherein the current supplied to the positive terminal 50, after being fed to a circuit breaker 52 is split between the input 54 of the woofer 26 and a mylar capacitor 56. The output of the capacitor 56 is again split so as to feed the input 58 of the tweeter 24 through a poly tweeter protective device 60, and also to feed an induction coil 62 connected to the ground terminal 64, the ground terminals 66, 68 of the woofer and tweeter respectively also being connected to the terminal 64. In the speaker system heretofore disclosed, the capacitor 56 is a 250 volt 2.2 microfarad unit and the coil 62 is a 0.3 microhenry unit.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An acoustic loud speaker cabinet enclosure comprising a front wall, a cabinet wall, a pair of side walls, a top and a bottom interconnected together to from a housing, at least a woofer speaker and a tweeter speaker mounted within the housing on said front wall, a port formed in one of said walls, a duct positioned in said port and extending into said housing for communicating air between the interior and exterior of said housing, at least one baffle secured to the interior of each of said front and back walls at vertically spaced apart dispositions intermediate said woofer and said duct, each of said baffles comprising a plate having a pair of spaced apart edges, a first of said edges being secured to the respective front and back wall, and the other of said edges extending toward the other wall and having a plurality of slots extending toward said first edge so as to define a plurality of spaced apart reed fingers which resonate at selected audio frequencies emitted from said woofer to reinforce the bass output from the enclosure.

2. An acoustic loud speaker cabinet enclosure as recited in claim 1, wherein the baffle secured to said front wall is disposed approximately mid-way between said woofer and the disposition of said duct.

3. An acoustic loud speaker cabinet enclosure as recited in claim 2, wherein the baffle secured to said rear wall is disposed within the peripheral envelope of said woofer.

4. An acoustic loud speaker cabinet enclosure as recited in claim, 1, wherein each of said baffles projects from the respective wall to which it is secured substantially half the distance between said front and rear walls.

5. An acoustic loud speaker cabinet enclosure as recited in claim 4, wherein each of said baffles extends from one side wall to the other side wall.

6. An acoustic loud speaker cabinet enclosure as recited in claim 5, wherein the baffle secured to said front wall is disposed approximately mid-way between said woofer and the disposition of said duct.

7. An acoustic loud speaker cabinet enclosure as recited in claim 6, wherein the baffle secured to said rear wall is disposed within the peripheral envelope of said woofer.

8. An acoustic loud speaker cabinet enclosure as recited in claim 1, wherein said port is disposed in one of said front and back walls.

9. An acoustic loud speaker cabinet enclosure as recited in claim 8, wherein each of said baffles projects from the respective wall to which it is secured substantially half the distance between said front and rear walls.

10. An acoustic loud speaker cabinet enclosure as recited in claim 9, wherein each of said baffles extends from one side wall to the other side wall.

11. An acoustic loud speaker cabinet enclosure as recited in claim 9, wherein the baffle secured to said front wall is disposed approximately mid-way between said woofer and the disposition of said duct.

12. An acoustic loud speaker cabinet enclosure as recited in claim 11, wherein the baffle secured to said rear wall is disposed within the peripheral envelope of said woofer.

13. An acoustic loud speaker cabinet enclosure as recited in claim 12, wherein each of said baffles extends from one side wall to the other side wall.

14. An acoustic loud speaker cabinet enclosure as recited in claim 4, wherein said slots extend approximately half the distance from said first edge to said other of said edges.

15. An acoustic loud speaker cabinet enclosure as recited in claim 14, wherein each of said baffles extends from one side wall to the other side wall.

16. An acoustic loud speaker cabinet enclosure as recited in claim 14, wherein the baffle secured to said front wall is disposed approximately mid-way between said woofer and the disposition of said duct.

17. An acoustic loud speaker cabinet enclosure as recited in claim 16, wherein the baffle secured to said rear wall is disposed within the peripheral envelope of said woofer.

18. An acoustic loud speaker cabinet enclosure as recited in claim 17, wherein each of said baffles extends from one side wall to the other side wall.

19. An acoustic loud speaker cabinet enclosure as recited in claim 14, wherein said port is disposed in one of said front and back walls.

20. An acoustic loud speaker cabinet enclosure as recited in claim 19, wherein the baffle secured to said front wall is disposed approximately mid-way between said woofer and the disposition of said duct.

21. An acoustic loud speaker cabinet enclosure as recited in claim 20, wherein the baffle secured to said rear wall is disposed within the peripheral envelope of said woofer.

* * * * *

UNITED STATES PATENT AND TRADEMARK OFFICE

CERTIFICATE OF CORRECTION

PATENT NO. : 5,170,436

DATED : December 8, 1992

INVENTOR(S) : Daryl G. Powell

It is certified that error appears in the above-identified patent and that said Letters Patent is hereby corrected as shown below:

Column 6, line 54 please delete "cabinet" and insert - - back - - in lieu thereof Signed and Sealed this Fifth Day of October, 1993

*Attest:*

Bruce Lehman

BRUCE LEHMAN

*Attesting Officer*

*Commissioner of Patents and Trademarks*